US008313002B2

(12) United States Patent
Tokunaga

(10) Patent No.: US 8,313,002 B2
(45) Date of Patent: Nov. 20, 2012

(54) LID FOR BEVERAGE CONTAINER

(76) Inventor: Shintaro Tokunaga, Tokyo (JP)

( * ) Notice: Subject to any disclaimer, the term of this patent is extended or adjusted under 35 U.S.C. 154(b) by 461 days.

(21) Appl. No.: 12/502,966

(22) Filed: Jul. 14, 2009

(65) Prior Publication Data

US 2010/0301048 A1 Dec. 2, 2010

(30) Foreign Application Priority Data

May 28, 2009 (JP) ..... 2009-129416

(51) Int. Cl.
*B65D 51/16* (2006.01)

(52) U.S. Cl. ..... 220/367.1; 220/713; 220/254.1; 229/404

(58) Field of Classification Search ..... 220/254.1, 220/254.3, 254.5, 254.7, 711, 713, 719, 374, 220/373, 367.1; 229/404, 400
See application file for complete search history.

(56) References Cited

U.S. PATENT DOCUMENTS

| | | | | |
|---|---|---|---|---|
| 4,589,569 | A * | 5/1986 | Clements | 220/380 |
| 4,752,016 | A * | 6/1988 | Eads | 220/253 |
| 5,688,545 | A | 11/1997 | Sanders | |
| 6,076,450 | A | 6/2000 | DiGiorgio, Jr. | |
| 6,431,390 | B1 * | 8/2002 | Waller | 220/713 |
| 6,578,726 | B1 * | 6/2003 | Schaefer | 220/253 |
| 7,140,510 | B2 | 11/2006 | Portman et al. | |
| 7,159,732 | B2 | 1/2007 | Smith et al. | |
| 2002/0170912 | A1 * | 11/2002 | Clarke | 220/254.1 |
| 2004/0118847 | A1 * | 6/2004 | Giraud | 220/254.3 |
| 2008/0000921 | A1 | 1/2008 | Leon | |
| 2008/0041862 | A1 * | 2/2008 | Bal | 220/711 |

FOREIGN PATENT DOCUMENTS

| | | | |
|---|---|---|---|
| JP | H05-054260 | U | 7/1993 |
| JP | H09-224803 | A | 9/1997 |
| JP | H11-255253 | A | 9/1999 |
| JP | 2002-240841 | A | 8/2002 |
| JP | 2003-112784 | A | 4/2003 |

* cited by examiner

*Primary Examiner* — David T. Fidei
*Assistant Examiner* — Robert Poon
(74) *Attorney, Agent, or Firm* — Muskin & Cusick LLC

(57) ABSTRACT

A lid for a beverage container includes a top wall. The top wall has a drink opening with a communicating hole and an aroma opening disposed near the drink opening. The aroma opening has a vertical aroma hole that is a through hole extending along a vertical plane essentially perpendicular to a horizontal plane of the top wall. The vertical aroma hole emits aroma of the beverage in the container to an outside, while preventing the beverage from splattering to the outside.

7 Claims, 15 Drawing Sheets

LID FOR BEVERAGE CONTAINER

CROSS REFERENCE TO RELATED APPLICATIONS

This application claims benefit to Japanese Patent Application No. 2009-129416, filed in the Japanese Patent Office on May 28, 2009, which is incorporated by reference herein in its entirety.

BACKGROUND OF THE INVENTION

This invention relates to a lid for a beverage container, particularly to a lid for a disposable beverage container for a fragrant beverage such as a coffee or a soup.

Conventional lids for beverage containers are disclosed in Japanese (Laid Open) Patent Publication No. 2002-240841 and Japanese (Laid Open) Patent Publication No. 2003-112784. No. 2002-240841 discloses a lid for a cup. No. 2003-112784 discloses a lid for a beverage container. They propose structures for enabling flavor of a beverage contained in the container to emit outside of the container. Specifically, the cup lid provides a round through hole as an opening for flavor diffusion at a center of the lid. The beverage container lid forms a large elliptical hole functioning as a drink opening as well as an outlet port for flavor emission as an integral element. In alternative embodiment, the container lid has a drink opening of a multi-flap structure made by overlapping cross-shaped slits, while arranging outlet ports of similar multi-flap structure for flavor emission near the drink opening as, as separate elements.

SUMMARY OF THE INVENTION

However, the opening portion of the cup lid is a single hole of a certain size and extends straightly toward a beverage in the cup. Thus, if the beverage in the cup splashes upward, the beverage will directly spatter out of the cup through the opening. In the same way, the outlet port integrated with the drink hole of the beverage container lid is just an opening obtained by merely cutting off the lid and directly faces the beverage in the container. Thus, if the beverage in the container splashes to the lid, the beverage will spatter out of the glass through the outlet port. On the other hand, in case of the multi-flap outlet ports, it is the cross-shaped slits that face the beverage in the container. Thus, the lid may prevent the beverage in the container from spattering outside. However, it is only the slits that permit the flavor of the beverage to be emitted outside. That is, the area of the opening made by the slits are very small and will hardly let the aroma off to the outside.

Then, it is an object of the present invention to provide a lid for a beverage container that has an opening portion of a size enough to give an aroma of a beverage in the beverage container and that, even if the beverage in the beverage container splashes toward the lid, is capable of surely preventing the beverage from spattering or leaking outside, thereby enabling a user to enjoy a sufficient amount of aroma while drinking the beverage.

According to one aspect of the invention, there is provided a lid for a beverage container. The lid includes an outer peripheral portion attachable to an upper edge of a container, and a main portion provided at an inside of the outer peripheral portion. The main portion includes a drink opening and an aroma opening disposed near the drink opening. The drink opening has a communicating hole as a through hole, and an aroma opening communicates an inside space of the main portion with an outside space. The aroma opening has at least one of the followings: a vertical aroma hole formed by a through hole extending along a first plane substantially perpendicular to a horizontal plane of the main portion, and a combination of a first non-vertical aroma hole and a second non-vertical aroma hole, the first non-vertical aroma hole being formed by a through hole extending along a second plane other than the first plane, the second non-vertical aroma hole being disposed at a position upper than the first non-vertical aroma hole and completely shifted in a horizontal direction from the first non-vertical aroma hole, and the second non-vertical hole extending along a third plane other than the first plane.

The main portion is preferably erected upward from the peripheral portion. The communicating hole passes through part of the main portion. The aroma opening is preferably disposed near the drink opening. The horizontal plane of the main portion defines a reference plane. The first plane may be a plane parallel to the horizontal plane or a plane intersecting with the horizontal plane or with an exactly vertical plane at an angle other than 90 degrees. The second non-vertical aroma hole is disposed at a location never overlapped with the first non-vertical aroma hole when seen from directly above. The second plane may be the horizontal plane itself or the like.

According to the invention, the container lid is provided with the aroma opening for emitting aroma in addition to the drink opening. The vertical aroma hole or the combination of the first and second non-vertical aroma holes in the aroma opening act as splash preventing means for preventing splattering of the beverage in the container. Thus, the beverage in the container is blocked from splashing from the aroma hole for aroma emission to the outside, while permitting only the aroma to be discharged to the outside in a sufficient amount. As a result, the container lid is capable of sufficiently diffusing the aroma of the beverage in the container to the outside, while preventing the splash of the beverage to the outside without fail.

Specifically, the inventive container lid may be constructed as follows. The main portion has substantially a cap shape integrally formed on the outer peripheral portion. The main portion has a side wall erected upward from the outer peripheral portion and a top wall extending in the horizontal direction from an upper end of the side wall. The drink opening of the main portion defines a hollow space recessed downward from the top wall, while being disposed near a first position of the outer peripheral portion. The aroma opening defines a hollow space recessed downward from the top wall, while being disposed to extend from the drink opening toward a second position of the outer peripheral portion that is opposite to the first position in a radial direction thereof. The aroma opening preferably extends up to proximity of the second position. The aroma opening includes at least an aroma hole wall and an inclined wall. The aroma hole wall hangs down in substantially a vertical direction and has the vertical aroma hole thereon. The vertical aroma hole is preferably provided at a lower end part of the aroma hole wall. The inclined wall extends upward in an inclined manner from a lower end of the aroma hole wall toward the top wall.

Thereby, when the user sets the drink opening to his or her lips, a hollow space of the shape corresponding to a nose of the user is provided at a location facing the nose of the user. The hollow opening enables the user to sense the aroma of the beverage more intensively. Moreover, the inclined wall continuously extends upward from the lower end of the aroma hole toward the top wall. Therefore, even if the beverage in the container splashes out of the aroma hole, the inclined wall blocks the beverage and prevents its splattering to the outside space. In addition, the beverage is guided along the inclined wall and returned into the container via the aroma hole.

Specifically, the inventive container lid may be constructed as follows. The aroma opening has a front wall, a rear wall and a pair of side walls. The front wall extends downward from a first end of the aroma opening, that is located at a side of the drink opening on the top wall, toward a center part of the top wall. The rear wall extends downward from a second end of the aroma opening, which is located at a side opposite to the side of the drink opening on the top wall, toward the center part of the top wall. The side walls connect lateral opposite ends of the front wall and the rear wall. The aroma opening defines the hollow space having the vertical aroma hole disposed at the center part of the top wall. The aroma opening has a width at a rear end of the rear wall smaller than a width at a front end of the front wall so that the aroma opening gradually tapers from the side of the drink opening toward the second position of the outer peripheral portion in plan view.

Thereby, the aroma hole is located at the center of the lid. When the beverage is waved in the container, the beverage tends to splash upward not at the center but at the outer circumferential area along the side wall of the container. Therefore, the aroma hole located at the center effectively prevents the beverage in the container from splattering to the outside. Moreover, the pair of the side walls slant at the lateral opposite sides of the aroma opening. Then, even if the beverage in the container splatters from the aroma hole to the outside, the beverage is smoothly flown to the aroma hole at the center in the space having the tapered plan shape defined by the side walls. Consequently, the container lid is able to stop splattering of the beverage to the outside with effect. Furthermore, when the user sets the drink opening to his or her lips, the aroma opening defined by the front wall, the rear wall and the side walls forms a hollow space of the shape corresponding to a nose of the user at a location facing the nose of the user. Thus, the hollow opening enables the user to sense the aroma of the beverage more intensively. More in detail, in case the aroma hole opens toward the rear wall (as in the first and the third embodiments described later), the rear wall extends downward. Then, even if the beverage in the container bounces out of the aroma hole by swaying or vibration, the beverage is shut off by the rear wall located just behind the aroma hole (at a rear position facing the aroma hole). Thus, the beverage is flown along the rear wall and smoothly returned to the container via the aroma hole. Moreover, even if the beverage in the container is bounced back at the rear wall to splatter upward, the beverage is blocked by the front wall located opposite to the rear wall. Thus, the beverage is flown along the front wall and smoothly returned to the container via the aroma hole. In the same manner, in case the aroma hole opens toward the front wall (as in the second embodiment described later), the front wall extends downward. Then, even if the beverage in the container bounces out of the aroma hole by swaying or vibration, the beverage is shut off by the front wall located just in front of the aroma hole (at a front position as a facing position). Thus, the beverage is flown along the front wall and smoothly returned to the container via the aroma hole. Moreover, even if the beverage in the container is bounced back at the front wall to splatter upward, the beverage is blocked by the rear wall located opposite to the front wall. Thus, the beverage is flown along the rear wall and smoothly returned to the container via the aroma hole.

Specifically, the inventive container lid may be constructed as follows. The container lid further includes a cap. The cap has one end integrally joined to one of the outer peripheral portion and an outer circumferential part of the main portion. The cap has a joint, an aroma opening closer and a drink opening closer integrally formed with each other so as to be aligned in a longitudinal direction of the cap. The joint of the cap integrally connects one of the outer peripheral portion and the outer circumferential part of the main portion with the aroma opening closer. The joint preferably has a band shape that integrally connects a lower edge of the outer peripheral portion with one end of the aroma opening closer. The aroma opening closer of the cap has such a cap shape as is fitted detachably into the aroma opening of the main portion so as to entirely close the aroma opening. That is, the aroma opening closer has an outline corresponding to an uppermost part of the aroma opening. The drink opening closer of the cap has such a cap shape as is fitted detachably into the drink opening of the main portion so as to entirely close the drink opening. That is, the drink opening closer has an outline corresponding to an uppermost part of the drink opening.

Thereby, the cap is provided on the outer peripheral portion or the main portion as an integral structure. The cap serves to close up the drink opening and the aroma opening by the drink opening closer and the aroma opening closer, respectively, at the time of non-drinking. Then, the cap blocks off any splattering of the beverage in the container to the outside and makes the container lid more sanitary. Moreover, the container lid having the non-vertical hole is advantageous because it can be made into a single or integral structure (one-piece structure) as a whole by an integral forming. The container lid having the cap adopts an integral structure in which the cap is coupled integrally to the outer peripheral portion or the main portion. Thus, it is easy to integrally form the cap and the part of the outer peripheral portion or the main portion (the part corresponding to the conventional lid) by a molding or forming of a synthetic resin or the like. Consequently, the container lid having the cap can be made into a single or integral structure (one-piece structure) as a whole by an integral forming, too.

DESCRIPTION OF THE PREFERRED EMBODIMENTS

Figure 1:
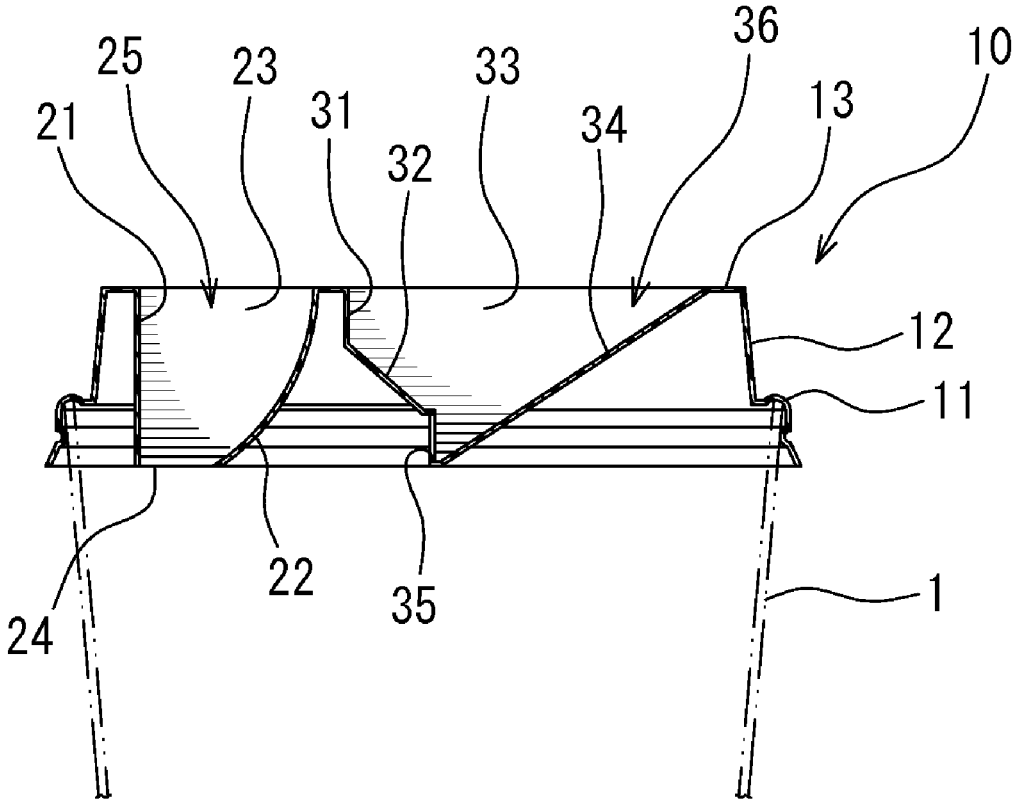
FIG. 1 is a sectional view showing a lid for a beverage container according to a first embodiment of the invention.

Several embodiments of the present invention are described below. The same reference character is used to show the same element throughout the several embodiments.

Figure 2:
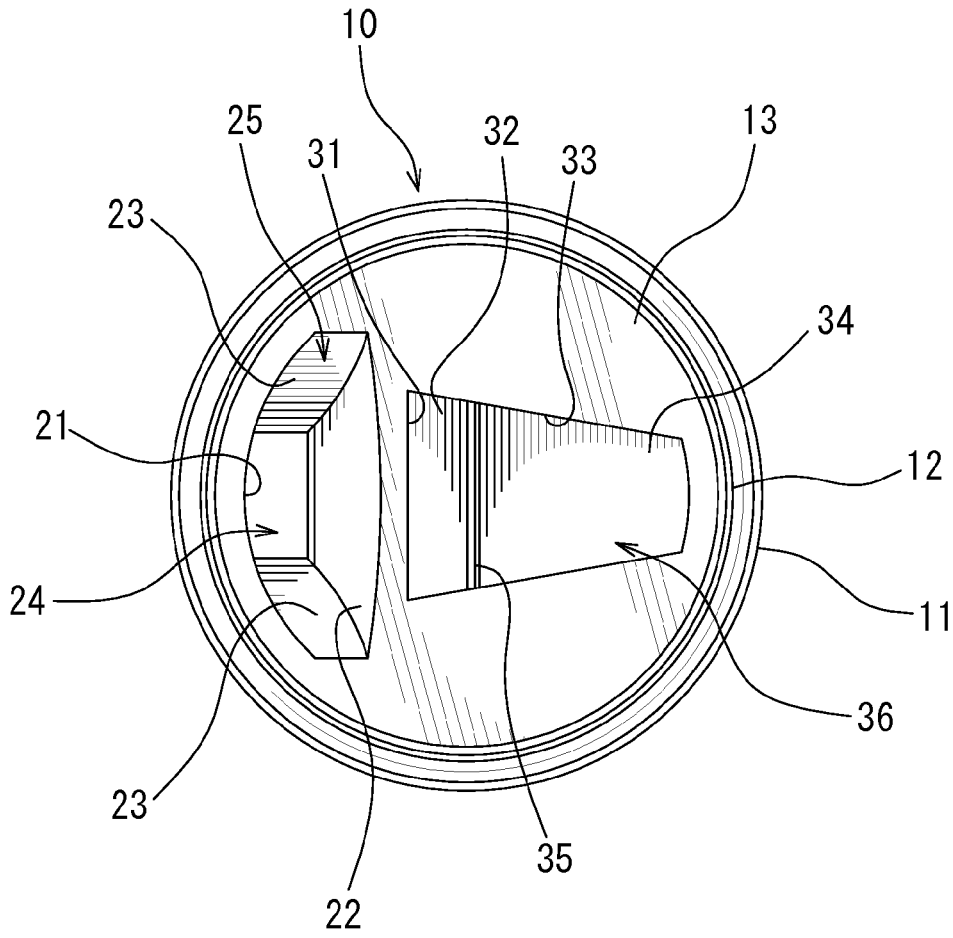
FIG. 2 is a plan view showing the lid for the beverage container according to the first embodiment of the invention.

As shown in FIG. 1 and FIG. 2, a lid for a beverage container according to the first embodiment is detachable fitted on an upper opening of a container part 1 of the beverage container such as a disposable coffee cup or the like. The lid has an outer peripheral portion 11 and a main portion 12, 13. The peripheral portion 11 is attachable to an upper edge of the container part 1. The main portion 12, 13 is raised upward from an inside edge of the peripheral portion 11. In detail, the main portion is composed of a side wall 12 and a top wall 13. The side wall 12 is erected upward from the peripheral portion 11. The top wall 13 extends horizontally from an upper end of the side wall 12. Thus, the main portion 12, 13 is made into substantially a cap shape integrally formed on the outer peripheral portion 11 The top wall 13 has a skeleton or three-dimensional structure as shown in FIG. 1 and FIG. 2. The main portion 12, 13 has a drink opening 25 on the top wall 13 as a top panel so as to form a recessed space at a fixed area near the side wall 12. The main portion has an aroma opening 36 on the top wall 13 so as to form another recessed space at a fixed area next to a rear side of the drink opening 25.

The drink opening 25 is a hollow space surrounded by a front wall 21, a rear wall 22 and a pair of side walls 23 that connect the lateral ends of the front wall 21 and the rear 22, respectively. The drink opening 25 forms the hollow space that is recessed downward from the top wall 13, while being located near a first position of an outer circumferential part of the container 1. Thus, the drink opening 25 defines a communicating hole 24 near a front end side or a side near the peripheral wall 12, as a through hole that passes through part of the top wall 13. In detail, the front wall 21 goes downward from a horizontal plane of the top wall 13 substantially in parallel with the peripheral wall 12. The rear wall 22 extends forward and downward in an inclined manner from a rear end of the drink opening 25 at the horizontal plane of the top wall 13. Each of the side walls 23 extends downward in an inclined manner from the horizontal plane of the top wall 13. toward the communicating hole 24. A lower edge of the front wall 21, a lower edge of the rear wall 22 and lower edges of the side walls 23 are disposed on a same plane as the lower edge of the peripheral wall 11 as the lower edge of the main portion. Then, the lower edges of the walls 21-23 define the communicating hole 24 of substantially laterally extending rectangular shape in plan view. Thereby, the hollow space of the drink opening 25 is made into a trumpet shape or a hone shape extending and tapering downward as a whole. Thus, the communicating hole 24 at the lower end of the opening 25 communicates with an inside space of the container 1. Consequently, when a hot drink is filled in the container 1, the hot drink is not allowed to flow from the communicating hole 24 too hastily into a mouth of a user. The hot drink from the communicating hole 24 flows in the hollow space of the drink opening 25, while containing the air at the hollow space, and then reaches the mouth of the user. As a result, the user is served with the drink of a little lower temperature than that inside the container 1. Consequently, the drink opening 25 is very effective for prevention of scald of the mouth of the user.

The aroma opening 36 forms a hollow space that is recessed downward from the top wall 13 so as to extend from the drink opening 25 to near a second position, diametrically opposite to the first position, of the peripheral portion 11. The aroma opening 36 has an aroma hole 35 as a through hole that makes an inside space of the main portion 12, 13 communicate with an outside space. The aroma opening 36 is disposed at a range from near the drink opening 25 to near the opposite position of the peripheral portion 12 via a central part of the top wall 13. In detail, the aroma opening 36 is the hollow space surrounded by a front wall 31, 32, 35, a rear wall 34 and a pair of side walls 33 that connect the lateral ends of the front wall 31, 32, 35 and the rear wall 34, respectively. The aroma opening 36 forms the aroma hole 35 at near the center part of the top wall 13 as the through hole that passes through the part of the top wall 13. Specifically, the front wall has a front vertical wall 31 and a front inclined wall 32. The front vertical wall 31 hangs down from the horizontal planer of the top wall 13 in parallel with the front wall 21. The front inclined wall 32 defines an inclined flat face that extends downward in an inclined manner from the lower end of the front vertical wall 31 to a vertically middle position of the main portion toward a radial center area of the main portion. The aroma hole 35 is formed on an aroma hole wall. That is, the aroma hole wall hangs down from the lower end of the front inclined wall 32 to a same position as the lower edge of the peripheral wall 11. Since the aroma hole 35 is formed on essentially an entire part of the aroma hole wall, the aroma hole wall is not depicted in FIG. 1. On the other hand, the rear wall or the rear inclined wall 34 defines a flat face that extends forward and downward in an inclined manner from a rear end of the aroma opening 36 at the horizontal plane of the top wall 13 to a position vertically facing the lower end of the front inclined wall 32. Each of the side walls 33 hangs downward vertically from the horizontal plane of the top wall 13 to the front vertical wall 31, the front inclined wall 32 and the rear inclined wall 34. Thereby, the side wall 34 has an outline matching with a cross-sectional shape of the front vertical wall 31, the front inclined wall 32 and the rear inclined wall 34 as a whole. Thus, the aroma opening 36 defines the hollow space of a cross-sectional shape tapering downwardly in sectional view as shown in FIG. 1 and a trapezoidal shape tapering rearward in plan view as shown in FIG. 2. Then, the aroma hole 35 at the lower end part of the aroma opening 36 communicates with the inside space of the container 1.

The aroma hole 35 as a vertical aroma hole of the present embodiment extends vertically between the pair of the side walls 33 and between the lower edge of the front inclined wall 32 and the lower edge or front edge of the rear inclined wall 34. That is, the aroma hole 35 defines a through hole of a laterally long rectangular shape that has a same height as an interval between the lower edge of the front inclined wall 32 and the lower edge of the rear inclined wall 34 and a same length as an interval at a position between the side walls 33 corresponding to the aroma hole 35. Then, the aroma hole 35 extends along a vertical plane that is substantially perpendicular to the horizontal plane as a reference planer of the main portion. Thus, the aroma hole 35 is disposed along the vertical plane. Specifically, the aroma hole 35 has its upper end and lower end located on the vertical plane or a plane parallel to an axis of the lid or the container 1. Then, the shape of the aroma hole 35 is not exposed when seen from upside or cannot be visually confirmed. Accordingly, when the lid is mounted on the container 1, the aroma hole 35 is never faced or opposite directly to the beverage inside the container 1. Consequently, the aroma hole 35 is the through hole having a structure that completely prevents and blocks the beverage from spattering outside even if the beverage splashes upward in the container 1. In the first embodiment, the aroma opening 36 has only the aroma hole 35 extending in generally the vertical direction and is not provided with another aroma hole.

Figure 3:
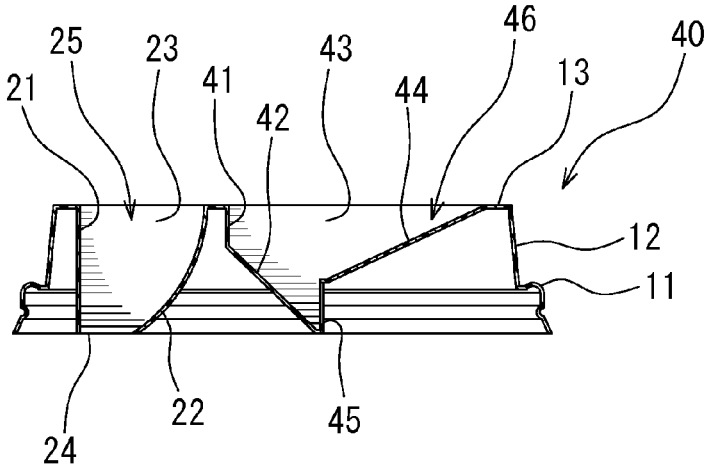
FIG. 3 is a sectional view showing a lid for a beverage container according to a second embodiment of the invention.
Figure 4:
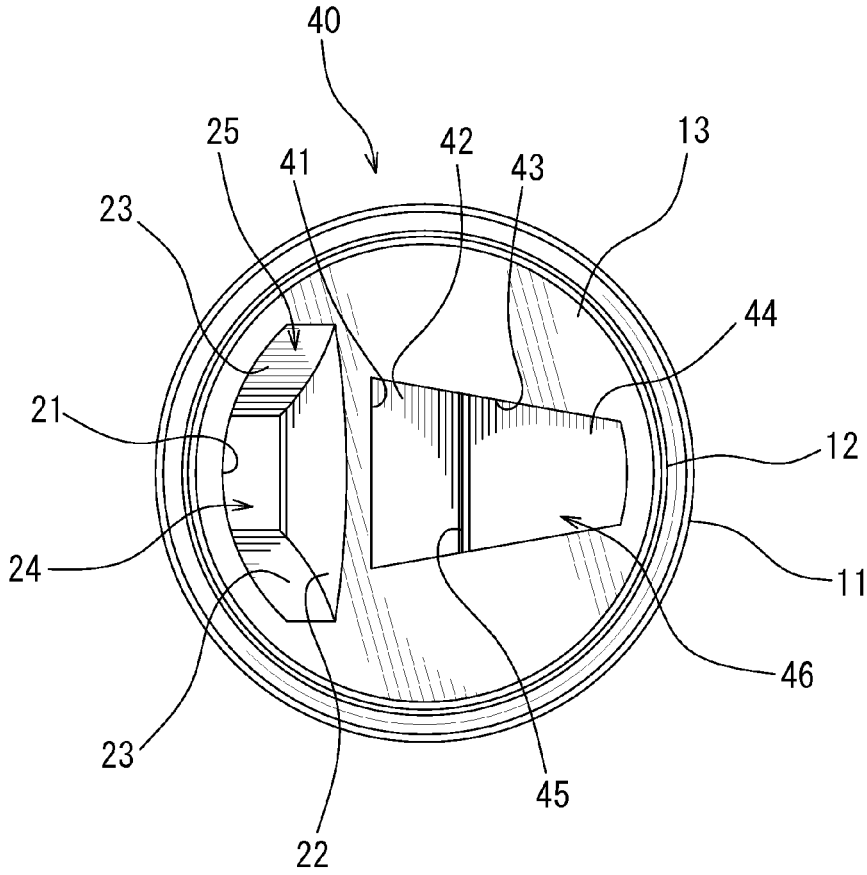
FIG. 4 is a plan view showing the lid for the beverage container according to the second embodiment of the invention.

In a second embodiment, as shown in FIG. 3 and FIG. 4, a lid for a beverage container according to the second embodiment is different from the lid of the first embodiment in a structure of an aroma opening 46. Specifically, the aroma opening 46 has essentially a same outline as the aroma opening 36 in plan view. The aroma opening 46 is disposed on the top wall 13 at substantially the same area as the aroma opening 36. The aromatic opening 46 forms a hollow space that is recessed downward from the top wall 13. The aroma opening 46 has an aroma hole 45 as a through hole that makes the inside space of the main portion 12, 13 communicate with an outside space. In detail, the aroma opening 46 is the hollow space surrounded by a front wall 41, 42, a rear wall 44 and a pair of side walls 43 that connect the lateral ends of the front wall 41, 42 and the rear wall 44, respectively. The aroma opening 46 forms the aroma hole 45 as a vertical aroma hole at near the center part of the top wall 13. More specifically, the front wall has a front vertical wall 41 and a front inclined wall 42. The front vertical wall 41 has the same structure as the front vertical wall 31. On the other hand, the front inclined wall 42 defines an inclined flat face that extends downward in an inclined manner from the lower end of the front vertical wall 41 to a lower end of the main portion toward the radial center area of the main portion. That is, the front inclined wall 42 hangs down lower than the front vertical wall 32 or up to the position corresponding to the lower end of the aroma hole 45. On the other hand, the rear wall or the rear inclined wall 44 defines a flat face that extends forward and downward in an inclined manner from a rear end of the aroma opening 46 at the horizontal plane of the top wall 13 to an upper position than the lower end of the front inclined wall 42 by a predetermined interval. The lower end or front end of the rear inclined wall 44 extends up to a position facing the upper end of the aroma hole 45. The aroma hole 45 is formed on an aroma hole wall. The aroma hole wall hangs down up to the lower end of the front inclined wall 42 that is at the same position as the lower edge of the peripheral wall 11. Since the aroma hole 45 is formed on essentially an entire part of the aroma hole wall, the aroma hole wall is not depicted in FIG. 3. Each of the side walls 43 hangs downward vertically from the horizontal plane of the top wall 13 to the front vertical wall 41, the front inclined wall 42 and the rear inclined wall 44, as in the side walls 33. Thus, the aroma opening 46 defines the hollow space of a cross-sectional shape tapering downwardly in sectional view as shown in FIG. 3 and a trapezoidal shape tapering rearward in plan view as shown in FIG. 4. Then, the aroma hole 45 at the lower end part of the aroma opening 46 communicates with the inside space of the container 1.

Figure 5:
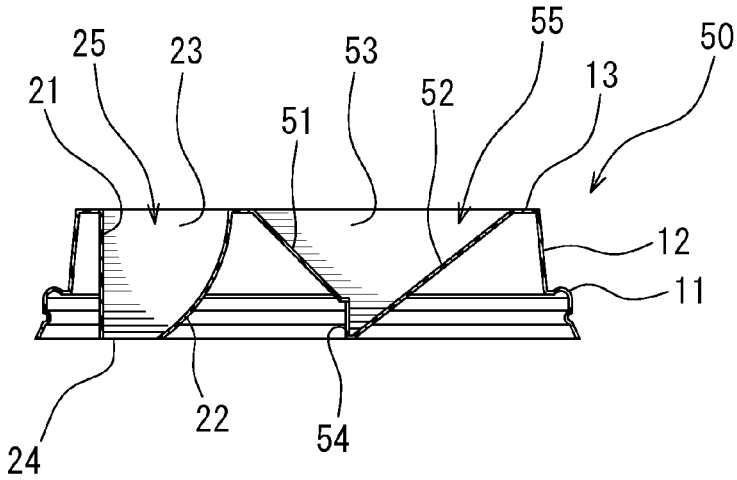
FIG. 5 is a sectional view showing a lid for a beverage container according to a third embodiment of the invention.
Figure 6:
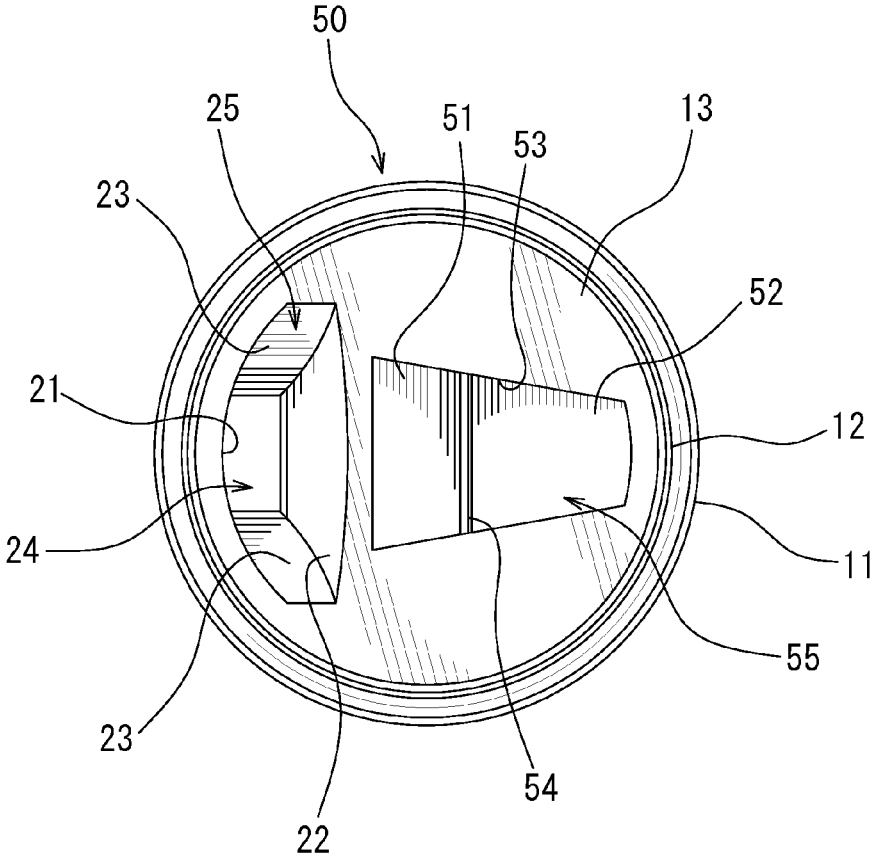
FIG. 6 is a plan view showing the lid for the beverage container according to the third embodiment of the invention.

In a third embodiment, as shown in FIG. 5 and FIG. 6, a lid for a beverage container according to the third embodiment is different from the lid of the first embodiment in a structure of an aroma opening 55. Specifically, the aroma opening 55 has essentially a same outline as the aroma opening 36 in plan view. The aroma opening 55 is disposed on the top wall 13 at substantially the same area as the aroma opening 36. The aromatic opening 55 forms a hollow space that is recessed downward from the top wall 13. The aroma opening 55 has an aroma hole 54 as a through hole that makes the inside space of the main portion 12, 13 communicate with an outside space. In detail, the aroma opening 55 is the hollow space surrounded by a front wall 51, a rear wall 52 and a pair of side walls 53 that connect the lateral ends of the front wall 51 and the rear wall 52, respectively. The aroma opening 55 forms the aroma hole 54 as a vertical aroma hole at near the center part of the top wall 13. More specifically, the front inclined wall 51 as the front wall defines an inclined flat face that extends downward in an inclined manner from the horizontal planer of the top wall to a vertical middle position of the main portion toward the radial center area of the main portion. On the other hand, the rear inclined wall 44 as the rear wall defines a flat face that extends forward and downward in an inclined manner from a rear end of the aroma opening 55 at the horizontal plane of the top wall 13 to a position vertically facing a lower end of the front inclined wall 51. The aroma hole 54 is formed on an aroma hole wall. The aroma hole wall hangs down from the lower end of the front inclined wall 51 to the lower end of the rear inclined wall 52 that is at the same position as the lower edge of the peripheral wall 11. Since the aroma hole 54 is formed on essentially an entire part of the aroma hole wall, the aroma hole wall is not depicted in FIG. 5. Each of the side walls 53 hangs downward vertically from the horizontal plane of the top wall 13 to the front vertical wall 51 and the rear inclined wall 52, as in the side walls 33. Thus, the aroma opening 54 defines the hollow space of a cross-sectional shape tapering downwardly in sectional view as shown in FIG. 5 and a trapezoidal shape tapering rearward in plan view as shown in FIG. 6. Then, the aroma hole 54 at the lower end part of the aroma opening 55 communicates with the inside space of the container 1.

In the first to the third embodiments, the aroma opening may be modified in other structures as long as it includes at least an aroma hole wall forming an aroma hole and an inclined wall that extends upward in an inclined manner from the lower end of the aroma hole toward the peripheral portion 11 of the lid. Moreover, the aroma hole wall may be modified in other structures as long as it extends downward at least in essentially a vertical direction, while having the vertical aroma hole preferably at its lower end portion. Furthermore, it is preferable to form the aroma hole wall such that the lower end of the vertical aroma hole coincides with the lower end of the aroma hole wall. In addition, the inclined wall may be structured in any way as long as it extends upward in an inclined manner from the lower end of the aroma hole wall toward the top wall 13.

The aroma opening may be structured in other ways as long as it is composed of a front wall, a rear wall and a pair of side walls. The front wall may be structured in any way as long as it extends downward from a marginal edge, at the side of the drink opening, of the top wall toward a radial center part of the top wall. The rear wall may be structured in any way as long as it extends downward from another marginal edge, which is opposite to the marginal edge at the side of the drink opening, of the top wall toward a radial center part of the top wall. The side walls may be structured in any way as long as they connect the lateral ends of the front wall and the rear wall, respectively. The aroma opening may be structured in any way as long as it has a recessed shape and makes the aroma hole located preferably at the radial center part of the top wall. Moreover, the aroma opening may have any desired hollow shape, but, is preferably formed into a shape that has a rear end width of the rear wall smaller than a width of a front end of the front wall so as to gradually taper from the drink opening 25 to the second position of the peripheral portion 11 in plan view.

The aroma opening may be structured such that it includes a front vertical wall, a front inclined wall, an aroma hole wall and a rear inclined wall as follows. That is, the front vertical wall hangs downward from the top wall at the front end (the end at the drink opening side) of the aroma opening. The front inclined wall extends downwardly in an inclined manner from the lower end of the front vertical wall toward the center part of the main portion. The aroma hole wall has an aroma hole that extends downward from the lower end of the front inclined wall. The rear inclined wall extends upward in an inclined manner from the lower end of the aroma hole wall toward the rear end (the second position of the peripheral portion). The aroma opening with such structure surely prevents the beverage splashing in the container from getting out of the aroma hole, since the aroma hole extends vertically and effectively shuts out the beverage typically splattered upward. Moreover, even if the beverage is splattered diagonally in the container and partly gets out of the aroma hole, the leaking beverage is completely blocked by the rear inclined wall and flows back along the rear inclined wall and returns into the container via the aroma hole. Furthermore, even if the beverage is bounced at the rear inclined wall, the beverage is guided downward along the front inclined wall. In addition, even if the beverage is bounced upward at the front inclined wall, the beverage is blocked by the front vertical wall and guided downward along the vertical wall. Therefore, the beverage is never spattered to the outside of the lid. As another advantage, the aroma opening is disposed, in relation to the drink opening, at a location corresponding to a nose of a user. Thus, when the user sets the cup to his or her lips to drink the beverage, the nose tip or nasal cavity of the user approaches the aroma opening or disposed inside the aroma opening. Consequently, the nose comes very near the aroma hole, so that the user is allowed to sense sufficient quantity of aroma or flavor of the drink and enjoy the aroma.

In a fourth embodiment, as shown in FIG. 7 to FIG. 10, a lid for a beverage container according to the fourth embodiment is provided with a cap 60 in addition to the structure of the first embodiment of the lid. Specifically, the cap 60 has a joint 61, an aroma opening closer 62 and a drink opening closer 63, which are integrally made into one body from an elastic or flexible material such as a synthetic resin. The joint 61 is shaped into a strip that integrally couples the lower end of the peripheral portion 11 and one end of the aroma opening closer 62. The joint 61 has a length a little longer than the distance from the lower end of the peripheral portion 11 to the rear end of the aroma opening 36. The aroma opening closer 62 has an outline corresponding to an uppermost opening part of the aroma opening 36 on the main portion. The aroma opening closer 62 has a cap shape that is fitted detachably into the aroma opening 36 from above so as to cover and close the entire aroma opening 36. More in detail, the aroma opening closer 62 is a cap having a trapezoidal outline as a whole corresponding to the outline of the aroma opening 36. The closer 62 has an inclined wall 63 at a front side thereof corresponding to the upper part of the rear inclined wall 34 of the aroma opening 36. Thus, the inclined wall 63 is touchable on the upper part of the rear inclined wall 34. The aroma opening closer 62 has a side wall 64 shaped into a trapezoidal outline corresponding to the outline of the aroma opening 36. Thus, the sidewall 64 is fitted close into an inner peripheral surface of the uppermost opening part (the upper parts of the front vertical wall 31, side walls 33 and rear inclined wall 34) of the aroma opening 36. Moreover, the aroma opening closer 62 has a flange 65 of a small width that is projected outward from a lower end of the side wall 64. The flange 65 is touchable onto an outer peripheral surface, around the aroma opening 36, of the top wall 13.

The drink opening closer 67 is coupled to the other end of the aroma opening closer 62 via a joint 66. The joint 66 has a short band shape that integrally couples the lower edge of the aroma opening closer 62 and a lower edge of the drink opening closer 67. the joint 66 has a groove 66A formed at its center of a lower surface for enhancing flexibility or bendability thereof. The drink opening closer 67 has an outline corresponding to an uppermost opening part of the drink opening 25 on the main portion. The drink opening closer 67 has a cap shape that is fitted detachably from above into the drink opening 25 so as to cover and close entirely the drink opening 25. More in detail, the drink opening closer 67 is a cap having essentially a rectangular outline as a whole corresponding to the outline of the drink opening 25. The closer 67 a side wall 68 shaped into essentially a rectangular outline corresponding to the outline of the drink opening 25. Thus, the sidewall 68 is fitted close into an inner peripheral surface of the uppermost opening part (the upper parts of the front wall 21, side walls 23 and rear wall 22) of the drink opening 25. Moreover, the drink opening closer 67 has a flange 69 of a small width that is projected outward from a lower end of the side wall 68. The flange 69 is touchable onto an outer peripheral surface, around the drink opening 25, of the top wall 13. A pinch tab 70 is formed integrally on a lower edge of the other end of the drink opening closer 67 so as to extend rearward. The one end of the joint 61 is not necessarily connected to the lower end of the peripheral portion 11, but may be connected to another part of the peripheral portion 11, the side wall 12 or the outer circumferential portion of the top wall 13, unless it hinders the opening/closing operation of the cap. That is, the cap 60 may be provided integrally on any part of the outer circumferential part of the peripheral portion 11 or the main portion 12, 13.

Figure 7:
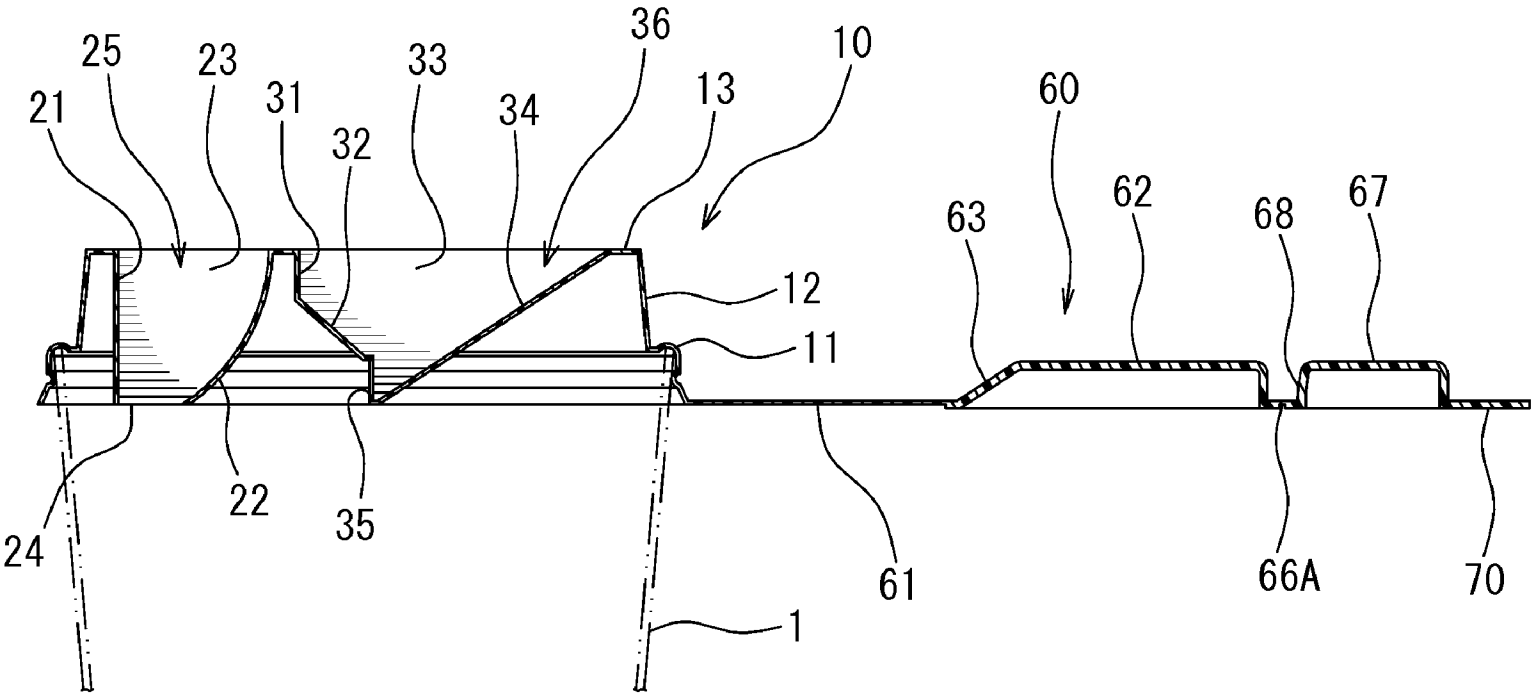
FIG. 7 is a sectional view showing a lid for a beverage container according to a fourth embodiment of the invention.
Figure 8:
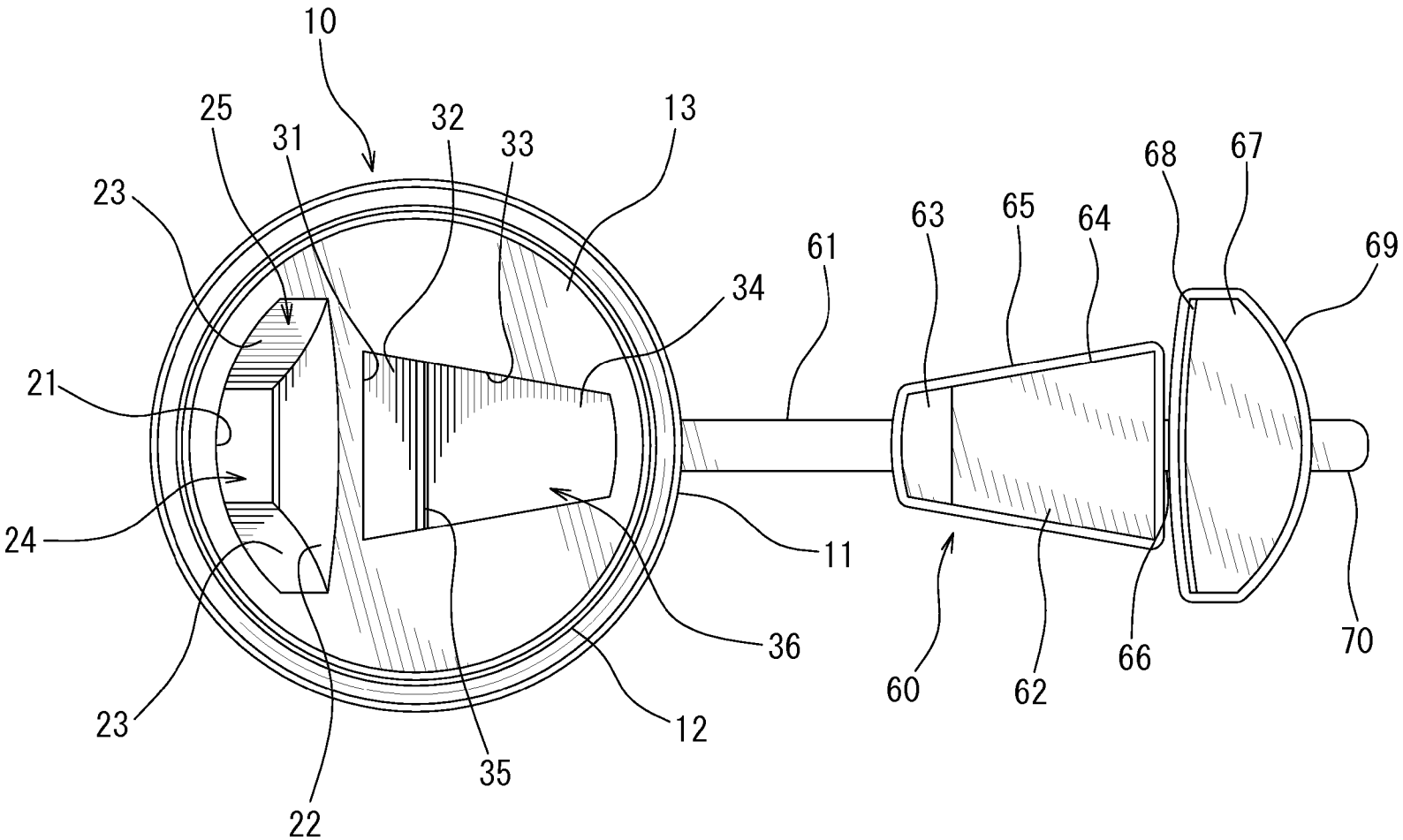
FIG. 8 is a plan view showing the lid for the beverage container according to the fourth embodiment of the invention.
Figure 9:
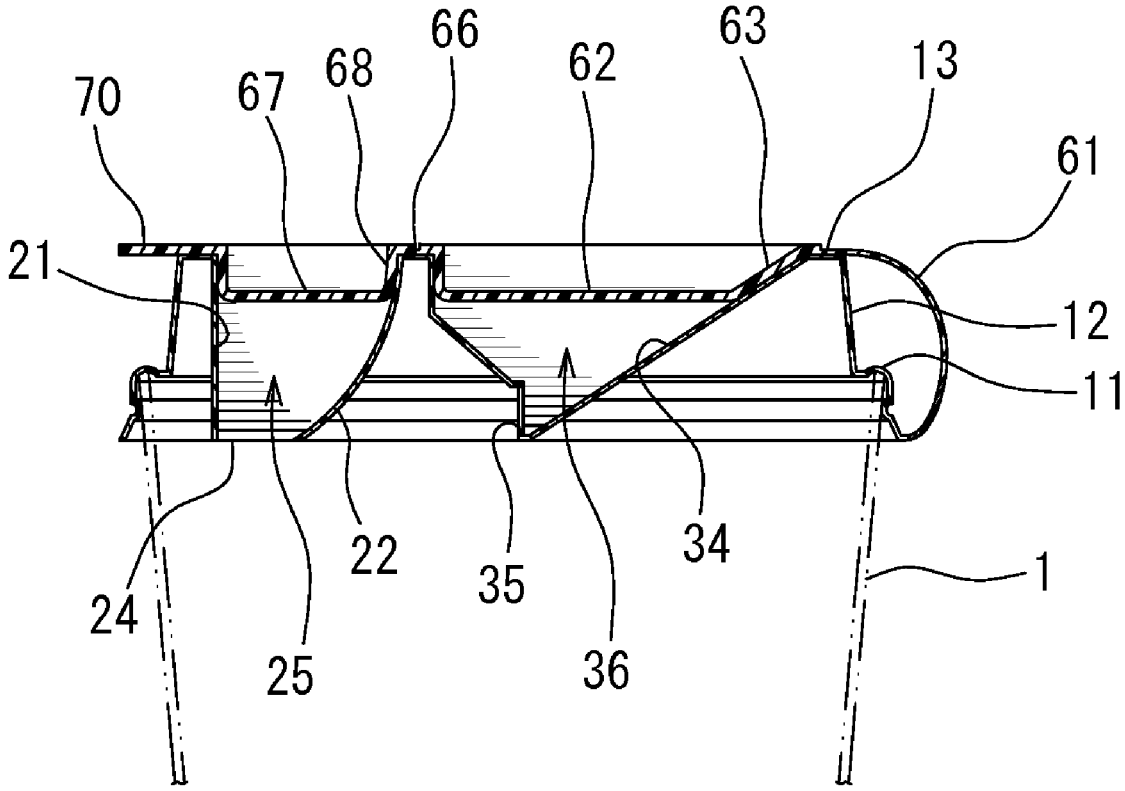
FIG. 9 is a sectional view showing the lid for the beverage container in a closing state of a drink opening and an aroma opening by a cap according to the fourth embodiment of the invention.
Figure 10:
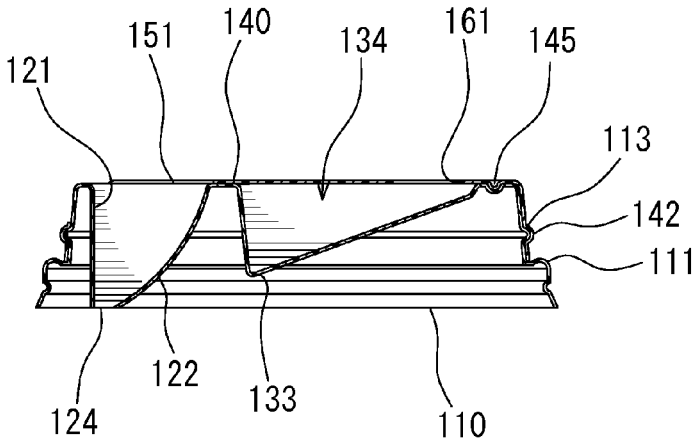
FIG. 10 is a sectional view showing a lid for a beverage container with an upper lid mounted on a lower lid according to a fifth embodiment of the invention.
Figure 11:
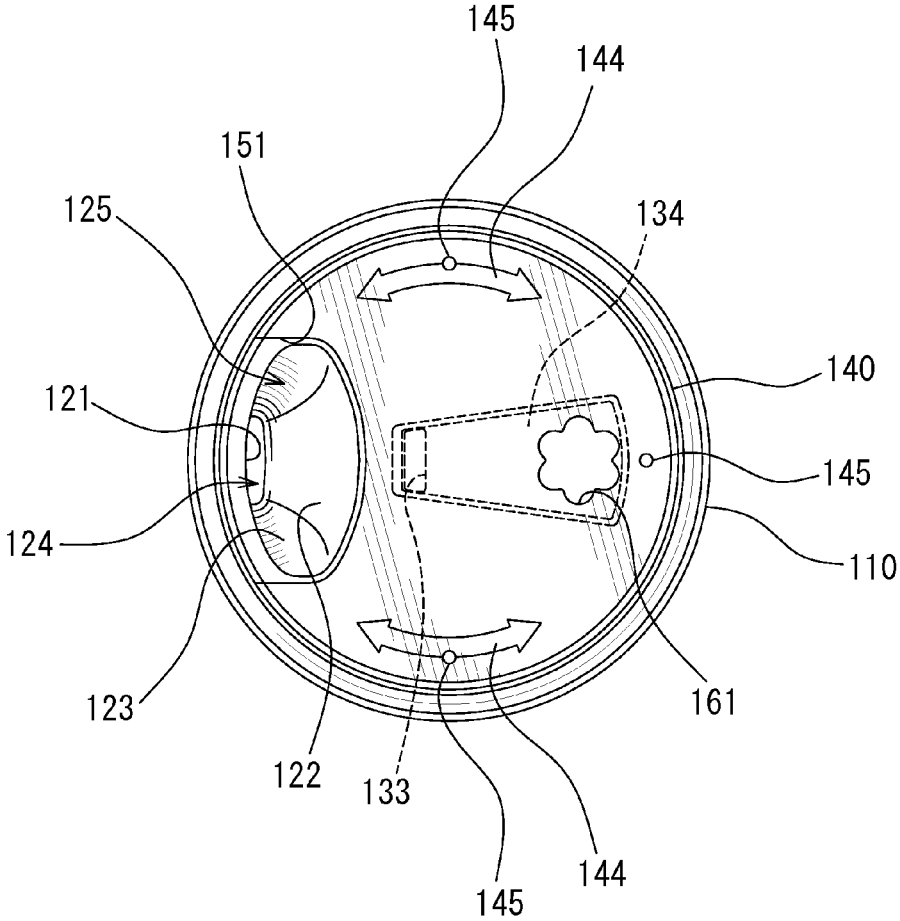
FIG. 11 is a plan view showing the lid for the beverage container with the upper lid mounted on the lower lid according to the fifth embodiment of the invention.
Figure 12:
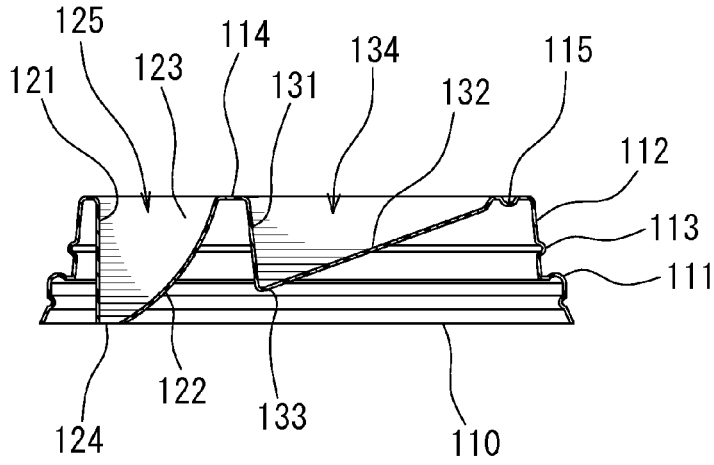
FIG. 12 is a sectional view showing the lower lid according to the fifth embodiment of the invention.
Figure 13:
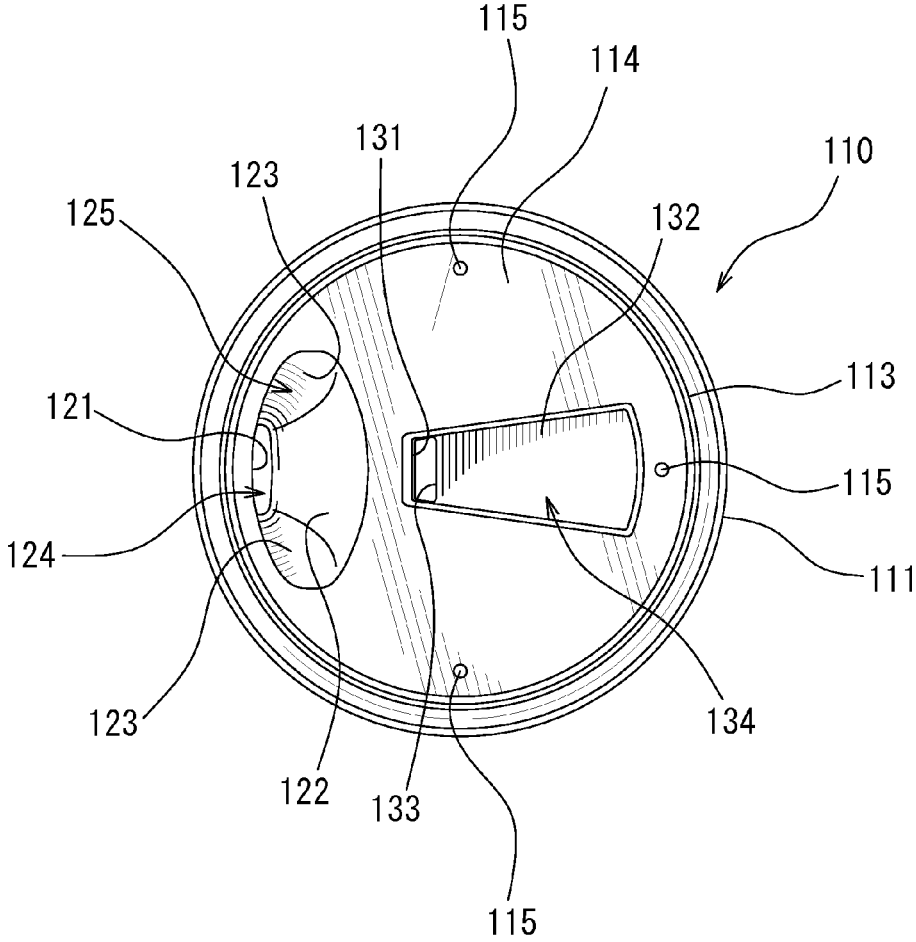
FIG. 13 is a plan view showing the lower lid according to the fifth embodiment of the invention.
Figure 14:
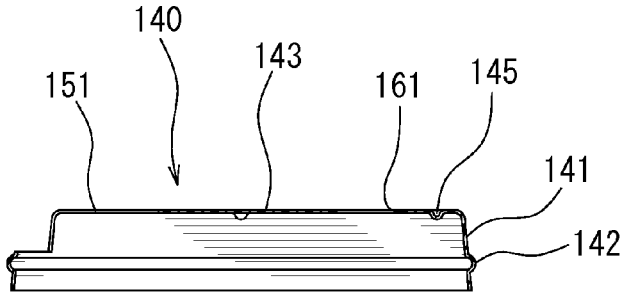
FIG. 14 is a sectional view showing the upper lid according to the fifth embodiment of the invention.
Figure 15:
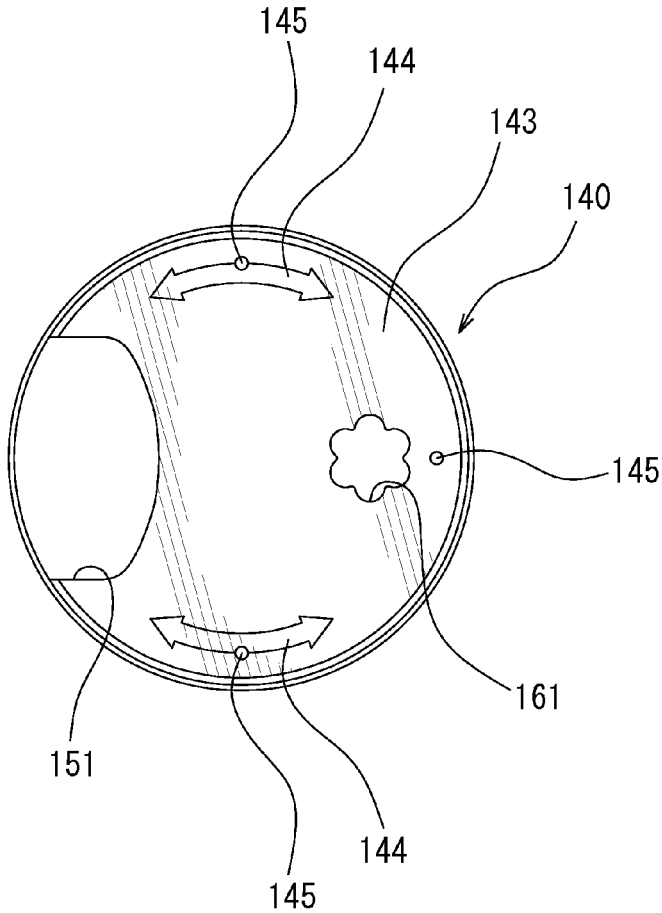
FIG. 15 is a plan view showing the upper lid according to the fifth embodiment of the invention.

In the fourth embodiment, the user pinches the tab 70 and moves or tilts the cap 60 upward and then forward from a closing position shown in FIG. 7 so as to fit the aroma opening closer 62 into the aroma opening 36 and the drink opening holder 67 into the drink opening 25, respectively. Thereby, as shown in FIG. 9, the aroma opening 36 and the drink 25 opening are completely closed. At this time the joint 61 is curved by its elasticity so as to extend from the lower edge of the peripheral portion 11 to a position near the rear end of the aroma opening 36. When drinking the beverage, the user pinches the tab 70 and moves or tilts the cap 60 upward and then rearward from an opening position shown in FIG. 9 so as to detach the aroma opening closer 62 from the aroma opening 36 and the drink opening holder 67 from the drink opening 25, respectively. Thereby, the aroma opening 36 and the drink 25 opening are completely opened.

In a fifth embodiment, as shown in FIG. 10 to FIG. 17, a lid for a beverage container according to the fifth embodiment has a drink opening 125 that is recessed downward. The drink opening 125 has essentially the same structure as the drink opening except that it has a slightly curved surface and curved outline. The drink opening 125 defines a hollow space surrounded by a front wall 121, a rear wall 122 and a pair of side walls 123 that connect the lateral ends of the front wall 121 and the rear 122, respectively. The drink opening 125 forms a communicating hole 124 similar to the communicating hole 24 at the side of the front wall 121. In contrast, an aroma opening 134 includes a plurality of aroma holes, i.e. a combination a first non-vertical aroma hole 133 and a second non-vertical aroma hole 161. In detail, according to the fourth embodiment, a main portion has a two-piece structure composed of a lower lid 110 and an upper lid 140, while the main portion according to the first to the third embodiments uses a one-piece structure. The lower lid 110 has a cap shape made by an outer peripheral portion 111 and a side wall 112 that is erected from the peripheral wall 111. The side wall 112 is integrally formed with a ring-shaped fitting 113 that has a small flange shape projected outward. A top wall 114 is formed with small semi-spherical dents 115 at three positions. Specifically, one of the dents or a center dent 115 is located at a rear side or rear position of the aroma opening 134 that is on an imaginary line extending in the radial direction connecting the drink opening 125 and the aroma opening 134. The other two dents 115 are located at positions separated 90 degrees in the clockwise direction and the counterclockwise direction, respectively, from the center dent 115. The aroma opening 134 is a recessed space surrounded by a front wall 131, a rear wall 132 and a pair of side walls 133. The front wall 131 is disposed at a front end of the aroma opening and extends downward substantially at right angles from the top wall 114. The rear wall 132 has a flat shape extending upward in an inclined manner from a lower end of the front wall 131 to the top wall 114 at a rear end of the aroma opening. The side walls 133 have a triangular plate shape each arranged at opposite lateral sides of the front wall 131 and the rear wall 132. The first non-vertical aroma hole 133 of the aroma opening 134 has a laterally long rectangular shape formed and penetrating along an entire width at a front end part of the rear wall 132.

The upper lid 140 has a side wall 141 adapted to be fitted close onto the side wall 112. A ring-shaped fitting 142 is integrally formed on the side wall 141 so as to be snap-fitted on the fitting ring 113. The side wall 141 is integrally formed with a top wall 143 of generally a disc shape so as to surround the top wall 143. The upper lid 140 has a cap shape that is fitted on the lower lid 110 from an upper side. The top wall 143 has small semi-spherical fitting protrusions 145 at positions matching with the fitting dents 115, respectively, on an outer circumferential part thereof. The protrusions 145 are adapted to be fitted into the dents 115, respectively. The top wall 143 has arrow marks 144 for showing rotating directions of the upper lid 140. The top wall 143 has an opening 151 of essentially a rectangular shape of a relatively large size that passes therethrough so as to wholly enclose the plan shape of the drink opening 124 at a position corresponding to the drink opening 125. Moreover, the top wall 143 has the second non-vertical aroma hole 161 passing therethrough at a position corresponding to the rear end part of the aromatic opening 134. The aroma hole 161 has substantially a star-shape or a flower-shape with a diameter little larger than the rear end part of the aroma opening 134. Thus, the fifth embodiment defines the aroma holes as the combination of the first non-vertical aroma hole 133 and the second non-vertical aroma hole 161 located at the positions that are never overlapped or that are completely shifted with each other in the horizontal direction. The first aroma hole may have any structure as long as it is composed of a through hole extending along a plane other than a vertical plane that is substantially perpendicular to the horizontal plane as the reference plane of the main portion. The second aroma hole may have any structure as long as it is composed of a through hole extending along a plane other than a vertical plane that is substantially perpendicular to the horizontal plane as the reference plane of the main portion, while being located at a position that is upper than the first aroma hole and complete shifted in the horizontal direction from the first aroma hole.

Figure 16:
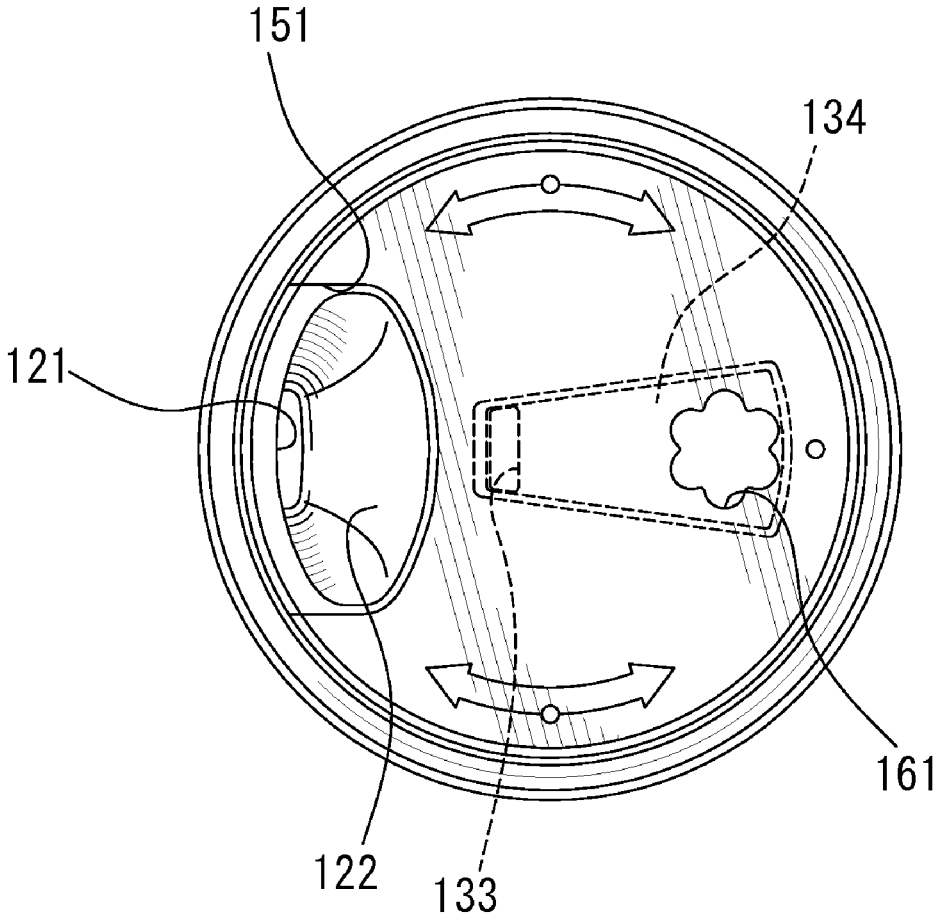
FIG. 16 is a sectional view showing a lid for a beverage container in a closing state according to the fifth embodiment of the invention.
Figure 17:
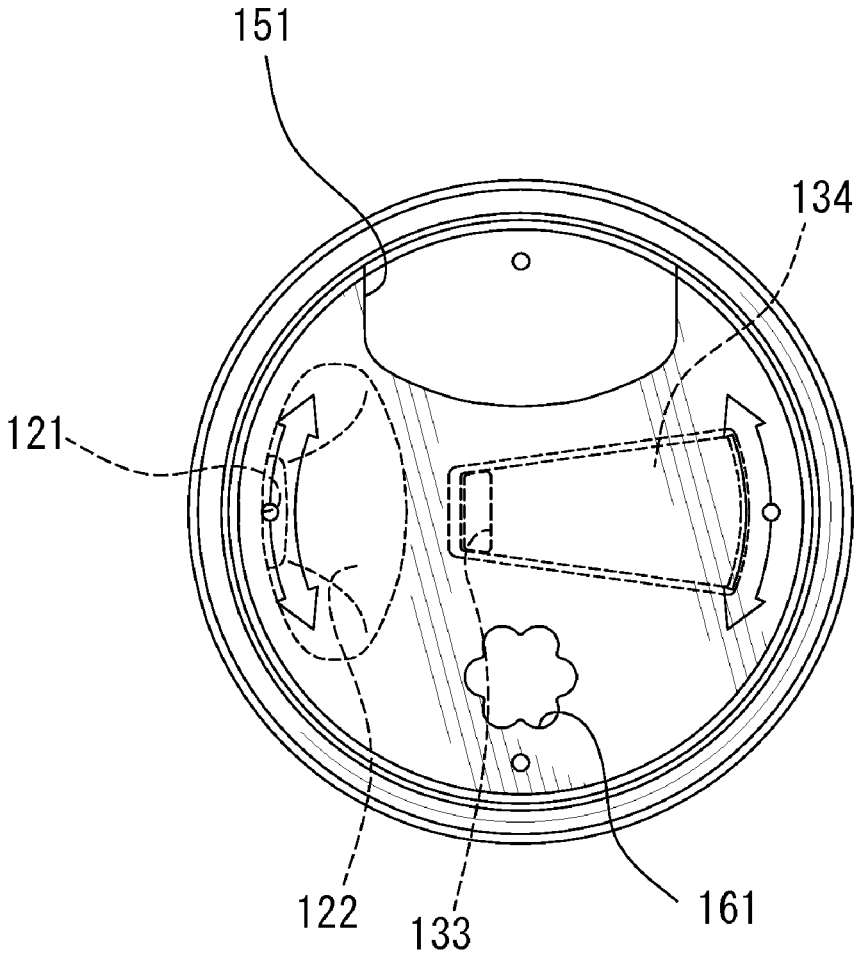
FIG. 17 is a plan view showing a lid for a beverage container in a closing state according to the fifth embodiment of the invention.

When drinking the beverage, as shown in FIG. 16, the user rotates the upper lid 140 relative to the lower lid 110 so as to expose the entire drink opening 125 of the lower lid 110 from the opening 151 of the upper lid 140. then, the second non-vertical aroma hole 161 of the upper lid 140 faces the space at the rear end part of the aroma opening 134 of the lower lid 110. Thus, the aroma inside the container 1 is emitted and discharged in sufficient quantity from the first non-vertical aroma hole 133 and the second non-vertical aroma hole 161 to the outside. At this time, even if the beverage in the container 1 is splattered from the first aroma hole 133 to the outside by swinging of the container 1 or the like, the upper lid 140 is located at a direct upside of the aroma hole 133 and reliably blocks the splattering beverage. On the other hand, when it is not used, the upper lid 140 is rotated relative to the lower lid 110 by 90 degrees from the opening state in FIG. 13 to the closing state in FIG. 17. Then, the top wall 143 at the side of the opening 151 covers the overall drink opening 125 of the lower lid 110. Moreover, the top wall 143 at the side of the second aroma hole 161 covers the entire aroma opening 134 of the lower lid 110. Consequently, the entirety of the drink opening 124 and the entirety of the aroma opening 134 are respectively shut off from the outside in the closed state. As a result, the lid surely prevents any leakage of the beverage to the outside, while effectively keeping the heat of the hot beverage. Moreover, the lid is very sanitary since the top wall 143 completely blocks off the drink opening 125 in the closed state. Furthermore, the fitting protrusions 145 are engaged with the fitting dents 115 to position the upper lid 140 at a desired angular position among three positions. Therefore, the upper lid 140 can be held at the predetermined position to the lower lid 110 without getting loose. The aroma opening 134 is the recessed space with the rear wall 132 inclined downward as in the first to the third embodiments. Therefore, even if the beverage becomes vapor and then condensed into dew inside the aroma opening 134 or the beverage in the container 1 is vibrated to leak from the first aroma hole 133 into the aroma opening 134, the beverage can be smoothly flown back along the slope of the rear wall 132 into the container via the first aroma hole 133. The first non-vertical hole 133 is located at the center part of the main portion as in the first to the third embodiments. Therefore, even if the container is tilted to a large degree, it is less possible that the beverage in the container 1 be flown or leaked to the outside via the first aroma hole 133. Moreover, even if the beverage in the container 1 leaks from the first aroma hole 133, the second aroma hole 161 at the completely shifted position shuts off the beverage without fail. Consequently, there is very low probability for the beverage to leak to the outside of the lid.

Figure 18:
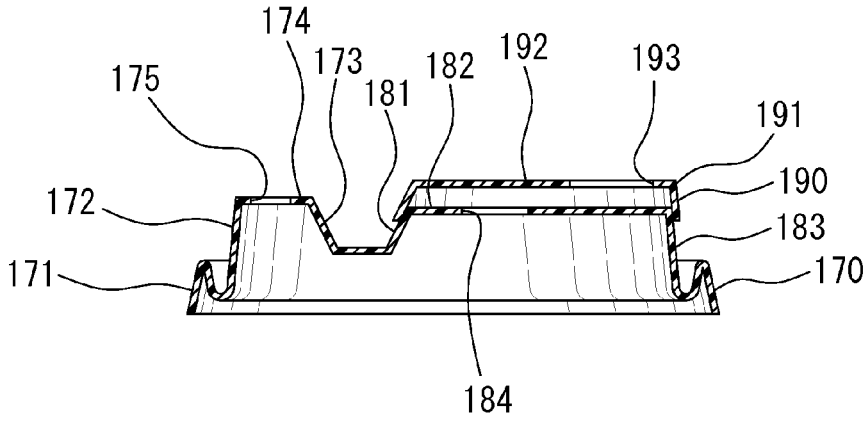
FIG. 18 is a sectional view showing a lid for a beverage container according to a sixth embodiment of the invention.
Figure 19:
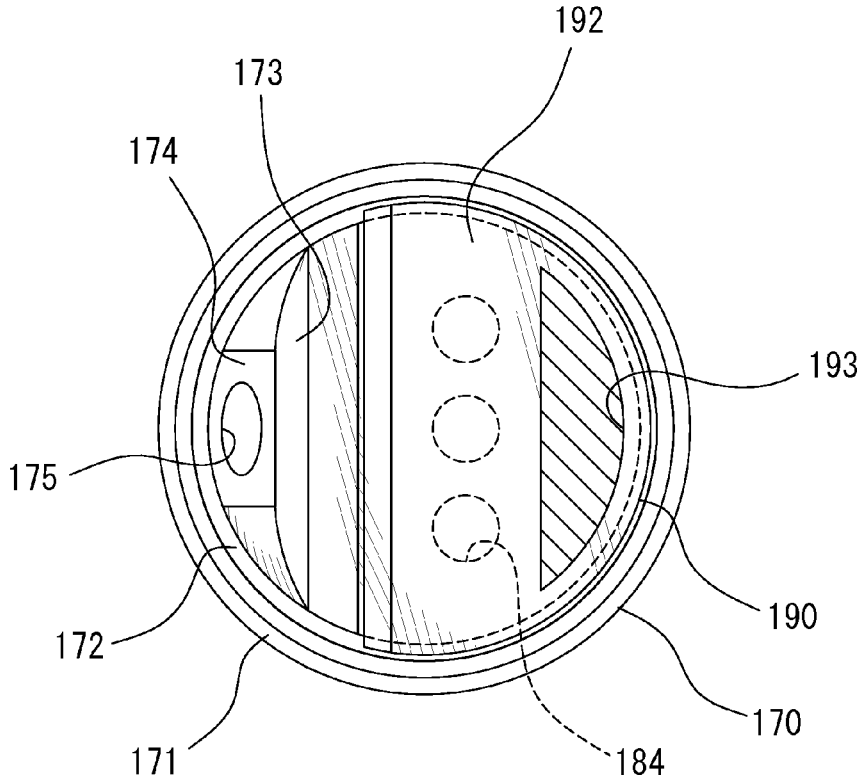
FIG. 19 is a plan view showing the lid for the beverage container according to the sixth embodiment of the invention.

In a sixth embodiment, as shown in FIG. 18 and FIG. 19, a lid for a beverage container according to the sixth embodiment has a two-piece structure including a lower lid 170 and an upper lid 190 as a main portion. The lower lid 170 has a cap shape made by an outer peripheral portion 171 and a side wall 172 that is erected from the peripheral wall 171. The lower lid 170 has a drink opening 174 in front of a straight dented groove 173. The drink opening 174 has a convex shape projected upward. The drink opening 174 has a communicating hole 175 as a through hole at a center of thereof. The lower lid 170 has a fitting portion for the upper lid 190 behind the dented groove 173. The fitting portion includes a front inclined wall 181 and a rear inclined wall 183. The front inclined wall 181 has a straight plate shape that extends along the dented groove 173. The rear inclined wall 183 has an arc plate shape connecting lateral ends of the front inclined wall 181. A top wall 182 is provided at upper ends of the front inclined wall 181 and the rear inclined wall 183. The top wall 182 has a plurality (three) of round through holes as first non-vertical aroma holes 184 so as to align in parallel with the dented groove 173 and at equal intervals to each other. The upper lid 190 has a side wall 191 fitted on the front inclined wall 181 and the rear inclined wall 183 from the outside. A top wall 192 is formed on an upper end of the side wall 191. The top wall 192 has a second non-vertical aroma hole 193 of a crescent shape passing therethrough. Thus, the sixth embodiment defines the aroma holes as the combination of the first non-vertical aroma holes 184 and the second non-vertical aroma hole 193 located at the positions that are never overlapped or that are completely shifted with each other in the horizontal direction.

Figure 20:
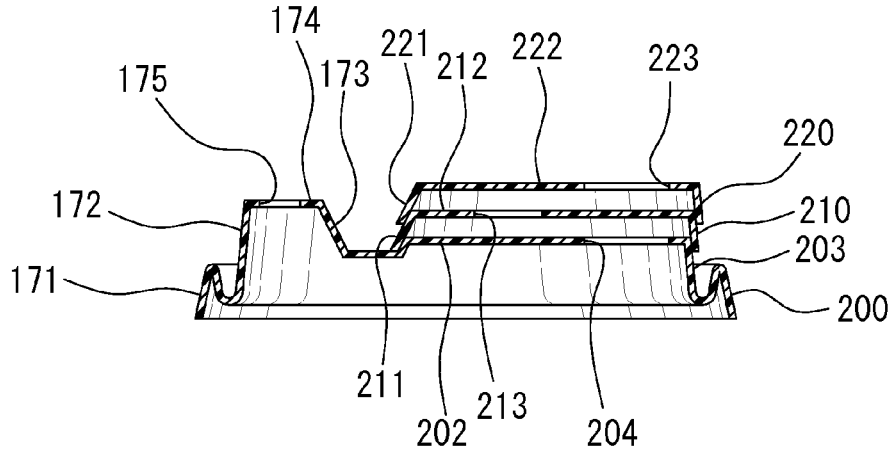
FIG. 20 is a sectional view showing a lid for a beverage container according to a seventh embodiment of the invention.
Figure 21:
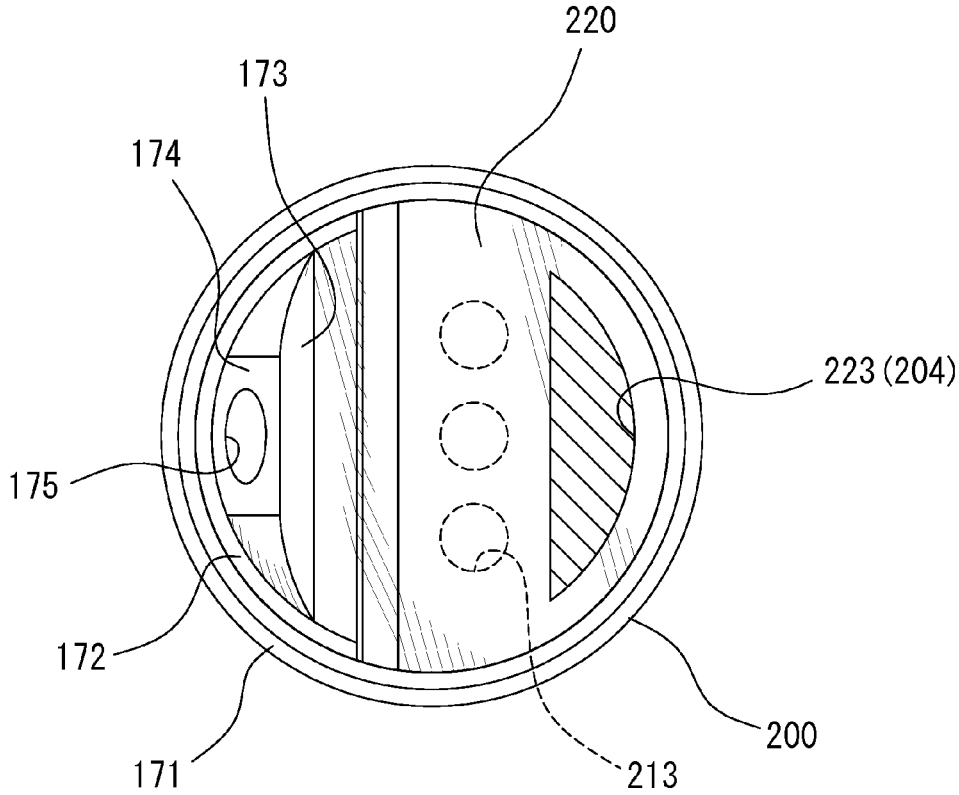
FIG. 21 is a plan view showing the lid for the beverage container according to the seventh embodiment of the invention.

In a seventh embodiment, as shown in FIG. 20 and FIG. 21, a lid for a beverage container according to the seventh embodiment has a three-piece structure including a lower lid 200, a middle lid 210 and an upper lid 220 as a main portion. The lower lid 200 has substantially the same structure as the lower lid 170. The lower lid 200 has a fitting portion at the rear of the dented groove 173 on which the middle lid 210 is mounted. The fitting portion includes a top wall 202 and a side wall 203. The top wall 202 has a first non-vertical aroma hole 204 passing therethrough with a similar shape to the second non-vertical aroma hole 193. The first aroma hole 204 is disposed at an area similar or corresponding to the second aroma hole 193. The middle lid 210 is fitting portion on which the upper lid 220 is mounted. The middle lid 210 includes a side wall 211 and a top wall 212. The top wall 212 has a plurality of second non-vertical aroma holes 213 passing therethrough with a similar shape to the first non-vertical aroma hole 184. The second aroma holes 223 are provided in the same number as the first aroma holes 184. The upper lid 220 includes a side wall 221 and a top wall 222. The top wall 222 has a third non-vertical aroma hole 223 passing therethrough with a similar shape to the second non-vertical aroma hole 193. The third aroma hole 223 is disposed at an area similar or corresponding to the second aroma hole 193. Thus, the seventh embodiment defines the aroma holes as the combination of the first non-vertical aroma holes 204, the second non-vertical aroma holes 213 and the third non-vertical aroma hole 223 located at the positions that are never overlapped or that are completely shifted with each other in the horizontal direction. Though the first aroma hole 204 and the third aroma hole 223 are located at a corresponding position, the second aroma hole 213 are interposed between them. As a result, the first to the third aroma holes 204, 213, 223 are located at the positions never overlapped or completely shifted with each other in the horizontal direction.

Figure 22:
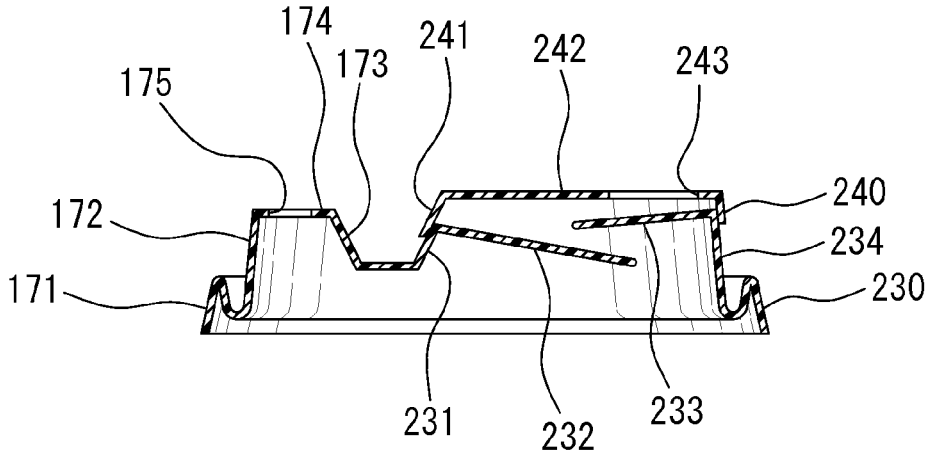
FIG. 22 is a sectional view showing a lid for a beverage container according to an eighth embodiment of the invention.
Figure 23:
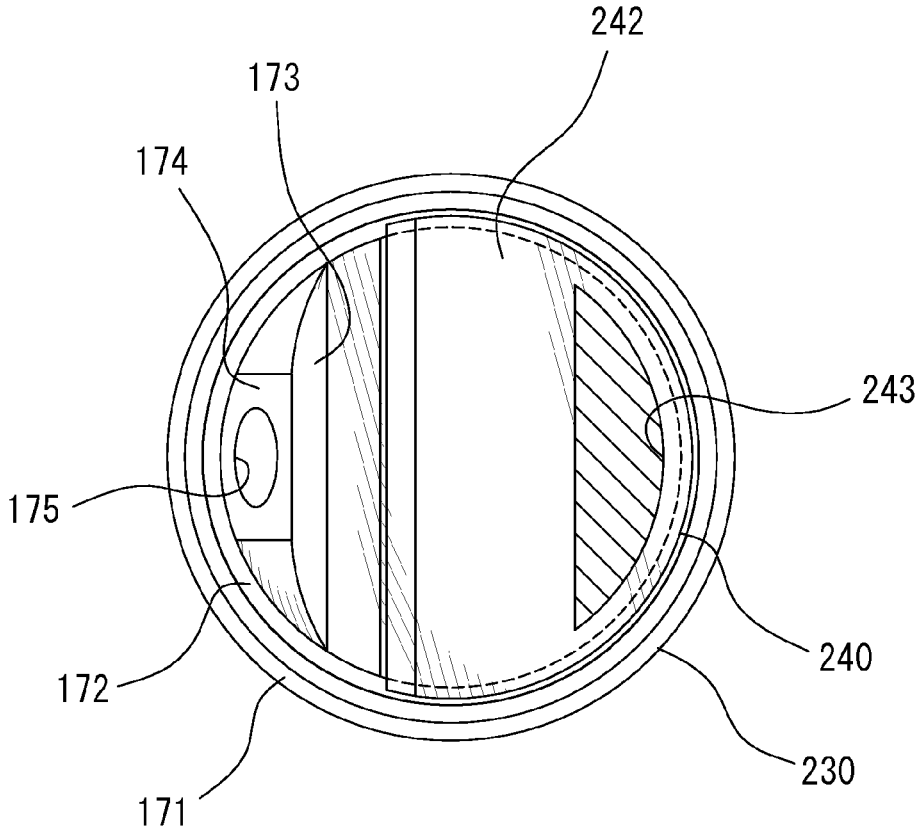
FIG. 23 is a plan view showing the lid for the beverage container according to the eighth embodiment of the invention.

In an eighth embodiment, as shown in FIG. 22 and FIG. 23, a lid for a beverage container according to the eighth embodiment has a two-piece structure including a lower lid 230 and an upper lid 240 as a main portion. The lower lid 230 has essentially the same structure as the lower lid 170. The lower lid 230 has a fitting portion at the rear of the dented groove 173 on which the upper lid 240 is mounted. The fitting portion includes a front inclined wall 231 of a straight plate shape extending along the groove 173 and a rear inclined wall 234 of an arc plate shape connecting opposite ends of the front inclined wall 231. A top wall is provided at upper ends of the front inclined wall 231 and the rear inclined wall 234. The top wall is has a front horizontal plate 232 and a rear horizontal plate 233. The front plate 232 extends rearward from the front inclined wall 231, while sloping slightly downward. The rear plate 233 extends forward from the rear inclined wall 234, while sloping slightly downward. The front plate 232 and the rear plate 233 are staggered one above the other such that a rear end part of the front plate 232 is disposed under a front end part of the rear plate 233 with a little interval. A space between the rear end of the front plate 232 and the front end of the rear plate 233 defines a first non-vertical aroma hole. Still, the first aroma hole can be deemed as a vertical aroma hole that extends vertically, when seen at the rear end position of the front plate 232 or at the front end position of the rear plate 233. the upper lid 240 has a side wall 241 that is fitted from an outside to the front inclined wall 231 and the rear inclined wall 234. A top wall 242 is provided at an upper end of the side wall 241. The top wall 242 has a second non-vertical aroma hole 243 passing therethrough with a similar shape to the second non-vertical aroma hole 193. The second aroma hole 243 is disposed at an area similar or corresponding to the second aroma hole 193. Thus, the eighth embodiment defines the aroma holes as the combination of the first non-vertical aroma hole (the space between the rear end of the front plate 232 and the front end of the rear plate 233) and the second non-vertical aroma holes 243 located at the positions that are never overlapped or that are completely shifted with each other in the horizontal direction. As described above, according to the eighth embodiment of the lid of the beverage container, the space formed between the front plate 232 and the rear plate 233 can be figured out as a vertical aroma hole. Therefore, the lid of the eighth embodiment performs the similar advantageous effects as those of the first to the third embodiments, even if the upper lid 240 is omitted. Accordingly, the vertical aroma hole of the invention is not limited to the embodiment in which it extend in an exactly vertical direction. The vertical aroma hole may extend in a slightly inclined manner relative to the vertical plane as long as it can prevent splattering of the drink out of the container in essence. Particularly, the lower end (leading end of the front plate) of the aroma hole may be located deeper than the upper end (leading end of the rear plate) as exemplified in the eighth embodiment. That is, the first to the third embodiment of the lids may provide an inclined aroma hole wall with a lower end located deeper than an upper end thereof. In this case, the aroma hole formed on the aroma hole wall becomes a through hole that cannot be confirmed visually from the upper side in any way. Thus, the aroma hole is capable of prevent the drink in the container from splattering to the outside without fail. Consequently, even if the inclination angle of the aroma hole wall is increased, the object of the invention is perfectly achieved.

Each of the beverage container lids is manufactured by integrally forming a predetermined powder material or a plastic material, typically a thermoplastic resin, into each of the above-mentioned shape of the piece by use of a press forming, an injection molding, a vacuum forming, a blow molding or the like. Particularly, the container lids according to the first to the fourth embodiment have the one-piece structure and are easy to be integrally molded by conventional molding or forming methods. Thus, the container lids according to the first to the fourth embodiment exceed in mass productivity, resource saving and cost reduction.

The lid for the beverage container of the present invention is applicable to any beverage container in which the aroma of the drink is an important factor for gusto or take of the user such as a disposable soup cup or the like, in addition to the disposable coffee cup.

The invention claimed is:

1. A lid for a beverage container comprising:

an outer peripheral portion attachable to an upper edge of a container; and a main portion provided at an inside of the outer peripheral portion, the main portion having a one-piece structure, wherein the main portion has a top wall extending along a horizontal plane, the main portion includes a drink opening and an aroma opening disposed near the drink opening, the drink opening has a communicating hole as a through hole, and an aroma opening communicates an inside space of the main portion with an outside space;

wherein the drink opening is disposed near a first position of the outer peripheral portion, wherein the aroma opening defines a hollow space recessed downward from the top wall, and the aroma opening is disposed next to the drink opening to extend toward a second position of the outer peripheral position that is opposite to the first position in a radial direction thereof, wherein the aroma opening includes at least an aroma hole wall, and the aroma hole wall hangs down along a first plane that is substantially perpendicular to the horizontal plane of the main portion, wherein the aroma hole wall has a vertical aroma hole thereon, the vertical aroma hole is a through hole extending along the first plane on the aroma hole wall, the vertical aroma hole has a size enough to give an aroma of a beverage in the beverage container to an outside, and the vertical aroma hole extends along the first plane providing splash preventing means for preventing the beverage in the beverage container from splattering to the outside, while permitting only the aroma to be discharged to the outside in a sufficient amount, wherein the aroma opening has a front wall, the aroma hole wall, a rear wall and a pair of side walls, the front wall extends downward from a first end of the aroma opening, that is located at a side of the drink opening on the top wall, toward a center part of the top wall, the aroma hole wall hangs down from a lower end of the front wall in substantially a vertical direction, the rear wall extends downward from a second end of the aroma opening, that is located at a side opposite to the side of the drink opening on the top wall, toward the center part of the top wall, and the side walls connect lateral opposite ends of the front wall and the rear wall, wherein the aroma opening defines the hollow space having the vertical aroma hole disposed at the center part of the top wall, and the aroma opening has a width at a rear end of the rear wall smaller than a width at a front end of the front wall so that the aroma opening gradually tapers from the side of the drink opening toward the second position of the outer peripheral portion in plan view.

2. A lid for a beverage container according to claim 1, wherein the main portion has substantially a cap shape integrally formed on the outer peripheral portion, the main portion has, as the one-piece structure, a side wall erected upward from the outer peripheral portion and the top wall extending in the horizontal direction from an upper end of the side wall, wherein the drink opening of the main portion defines a hollow space recessed downward from the top wall, while being disposed near the first position of the outer peripheral portion, wherein the aroma opening further includes an inclined wall, and the inclined wall extends upward in an inclined manner from a lower end of the aroma hole wall toward the top wall; and wherein the vertical aroma hole is formed on essentially an entire part of the aroma hole wall.

3. A lid for a beverage container according to claim 2, further comprising:

a cap joined to the main portion;

wherein the cap has an aroma opening closer and a drink opening closer, wherein the aroma opening closer of the cap has such a cap shape as is fitted detachably into the aroma opening of the main portion so as to entirely close the aroma opening, and wherein the drink opening closer of the cap has such a cap shape as is fitted detachably into the drink opening of the main portion so as to entirely close the drink opening.

4. A lid for a beverage container according to claim 2, wherein the vertical aroma hole is provided at a lower end part of the aroma opening, and the inclined wall extends upward in an inclined manner from a lower end of the vertical aroma hole.

5. A lid for a beverage container comprising:

an outer peripheral portion attachable to an upper edge of a container; and a main portion provided at an inside of the outer peripheral portion, the main portion having a one-piece structure;

wherein the main portion has a top wall extending along a horizontal plane, the main portion includes a drink opening and an aroma opening disposed near the drink opening, the drink opening has a communicating hole as a through hole, and an aroma opening communicates an inside space of the main portion with an outside space, wherein the drink opening is disposed near a first position of the outer peripheral portion, wherein the aroma opening defines a hollow space recessed downward from the top wall, and the aroma opening is disposed next to the drink opening to extend toward a second position of the outer peripheral position that is opposite to the first position in a radial direction thereof, wherein the aroma opening includes at least an aroma hole wall, and the aroma hole wall hangs down along a first plane that is substantially perpendicular to the horizontal plane of the main portion, wherein the aroma hole wall has a vertical aroma hole thereon, the vertical aroma hole is a through hole extending along the first plane on the aroma hole wall, the vertical aroma hole has a size enough to give an aroma of a beverage in the beverage container to an outside, and the vertical aroma hole extends along the first plane providing splash preventing means for preventing the beverage in the beverage container from splattering to the outside, while permitting only the aroma to be discharged to the outside in a sufficient amount, wherein the main portion has substantially a cap shape integrally formed on the outer peripheral portion, the main portion has, as the one-piece structure, a side wall erected upward from the outer peripheral portion and the top wall extending in the horizontal direction from an upper end of the side wall, wherein the drink opening of the main portion defines a hollow space recessed downward from the top wall, while being disposed near the first position of the outer peripheral portion, wherein the aroma opening includes a front wall, the aroma hole wall, an inclined rear wall and a pair of side walls, the front wall hanging down from the top wall at a side of the drink opening, the aroma hole wall hanging down from a lower end of the front wall in substantially a vertical direction, the inclined rear wall extending upward in an inclined manner from a lower end of the aroma hole wall toward the top wall and away from the drink hole, and the pair of side walls connecting the front wall and the rear wall, wherein the vertical aroma hole is provided on the aroma hole wall and configured such that upon application of the beverage container to a user's lips the user's nasal cavity would be in close proximity to the vertical aroma hole providing a sufficient quantity of aroma of the beverage to the user's nasal cavity.

6. A lid for a beverage container according to claim 5, wherein the front wall has a front vertical wall and a front inclined wall, the front vertical wall hanging down from the top wall, and the front inclined wall extending downward in an inclined manner from the lower end of the front vertical wall to a vertically middle position of the main portion toward a radial center area of the main portion.

7. A lid for a beverage container according to claim 6, wherein the vertical aroma hole has a same height as an interval between a lower edge of the front inclined wall and a lower edge of the rear inclined wall, while having a same length as an interval between the side walls so that the vertical aroma hole is provided on essentially an entire part of the aroma hole wall.

* * * * *